US011146010B2

(12) United States Patent
Evans

(10) Patent No.: US 11,146,010 B2
(45) Date of Patent: Oct. 12, 2021

(54) OVERMOLDED CONTACT ASSEMBLY

(71) Applicant: TE Connectivity Services GmbH, Schaffhausen (CH)

(72) Inventor: Nicholas Lee Evans, Harrisburg, PA (US)

(73) Assignee: TE Connectivity Services GmbH

( * ) Notice: Subject to any disclaimer, the term of this patent is extended or adjusted under 35 U.S.C. 154(b) by 0 days.

(21) Appl. No.: 16/706,939

(22) Filed: Dec. 9, 2019

(65) Prior Publication Data

US 2021/0175655 A1 Jun. 10, 2021

(51) Int. Cl.
*H01R 13/41* (2006.01)
*H01R 43/20* (2006.01)

(52) U.S. Cl.
CPC ..... *H01R 13/41* (2013.01); *H01R 43/20* (2013.01)

(58) Field of Classification Search
CPC ..... H01R 43/20; H01R 13/41
See application file for complete search history.

(56) References Cited

U.S. PATENT DOCUMENTS 4,902,092 A * 2/1990 Grandy ..... G02B 6/3885 385/56
5,975,917 A * 11/1999 Wang ..... H01R 43/20 29/884
8,262,412 B1 * 9/2012 Minnick ..... H01R 13/6587 439/607.01
9,225,122 B1 * 12/2015 Evans ..... H01R 13/6587
9,281,598 B2 3/2016 Zebhauser et al.
9,806,468 B2 * 10/2017 Liao ..... H01R 4/023
9,935,385 B2 * 4/2018 Phillips ..... H01R 13/516
9,941,608 B2 4/2018 Zebhauser et al.
10,249,995 B2 4/2019 Zebhauser et al.
10,347,397 B2 7/2019 Armbrecht et al.
10,389,062 B2 8/2019 Zebhauser et al.
10,396,472 B2 8/2019 Baldauf et al.
10,553,977 B2 2/2020 Pemwieser et al.
10,594,104 B2 3/2020 Hofling
2004/0266266 A1 * 12/2004 Lai ..... H01R 13/65918 439/607.27
2011/0223807 A1 * 9/2011 Jeon ..... H01R 13/6473 439/620.22
2015/0132994 A1 5/2015 Zebhauser et al.
2017/0040087 A1 2/2017 Armbrecht et al.
2018/0366856 A1 12/2018 Pemwieser et al.
2019/0058296 A1 2/2019 Bredbeck
2019/0103692 A1 * 4/2019 Consoli ..... H01R 13/40
2019/0148865 A1 5/2019 Zebhauser et al.
2020/0067236 A1 * 2/2020 Ljubijankic ..... H05K 3/3447
2020/0381867 A1 * 12/2020 Ljubijankic ..... H01R 43/24

* cited by examiner

*Primary Examiner* — Abdullah A Riyami
*Assistant Examiner* — Marcus E Harcum

(57) ABSTRACT

An electrical connector having a housing and overmolded contact assemblies. The housing has a mating face and a mounting face. Contact receiving cavities extend from the mating face to the mounting face. The overmolded contact assemblies are provided in the contact receiving cavities. The overmolded contact assemblies include contacts and overmolded housings. The contacts have mating contact portions, securing portions and mounting contact portions. The overmolded housings are overmolded onto the securing portions of the contacts.

16 Claims, 3 Drawing Sheets

OVERMOLDED CONTACT ASSEMBLY

FIELD OF THE INVENTION

The present invention is directed to an overmolded contact assembly and method for use in an electrical connector. In particular, the invention is directed to an overmolded contact assembly for use in a header or the like.

BACKGROUND OF THE INVENTION

Many electrical connectors have pins or other contacts which extend through the housing of the connectors. The terminals have a first end which are exposed for engagement with the terminals of a mating connector and a second end for interconnecting circuit boards such as a back plane or a daughter board. The contacts are typically inserted into contact receiving cavities of the housing and are secured therein. Such contacts are often drawn-wire or screw machined pins which are often inserted straight and are then bend down to form the second end. During this process, the pins may not be properly aligned with the cavities causing stubbing or damage to the contact of the cavities of the housing. In addition, the process may not be advantageous in connectors in which a small number of contacts are used A need remains for a connector that addresses these shortcomings in a cost effective manner and without adding to the size or complexity of the connector.

It would be, therefore, beneficial to provide an overmolded contact assembly for use with an electrical connector which allows for the proper insertion and positioning of the contacts in the housing in a cost effective manner and without adversely impacting the size or complexity of the connector.

SUMMARY OF THE INVENTION

An embodiment is directed to a contact assembly for insertion into an electrical connector. The contact assembly has a contact having a mating contact portion, a securing portion and a mounting contact portion. The contact assembly also has an overmolded housing. The overmolded housing is overmolded onto the securing portion of the contact.

A first side of the overmolded housing has at least one recess and a second side of the overmolded housing has at least one projection. The positioning of the at least one projection on the second side of the overmolded housing relative to the mating contact portion and the mounting contact portion is identical to the positioning of the at least one recess on the first side of the overmolded housing relative to the mating contact portion and the mounting contact portion. The number of the at least one projections provided on the second side of the overmolded housing are equal to the number of at least one recesses provided on the first side of the overmolded housing.

An embodiment is directed to an electrical connector having a housing and overmolded contact assemblies. The housing has a mating face and a mounting face. Contact receiving cavities extend from the mating face to the mounting face. The overmolded contact assemblies are provided in the contact receiving cavities. The overmolded contact assemblies include contacts and overmolded housings. The contacts have mating contact portions, securing portions and mounting contact portions. The overmolded housings are overmolded onto the securing portions of the contacts.

An embodiment is directed to a method of forming a contact assembly for insertion into an electrical connector.

The method includes: positioning a contact in a mold, the contact having a securing portion; holding the contact at discrete locations of the securing portion; overmolding a housing over the securing portion of the contact; and forming at least one mating member on a side of the housing during the overmolding.

Other features and advantages of the present invention will be apparent from the following more detailed description of the preferred embodiment, taken in conjunction with the accompanying drawings which illustrate, by way of example, the principles of the invention.

DETAILED DESCRIPTION OF THE INVENTION

Figure 1:
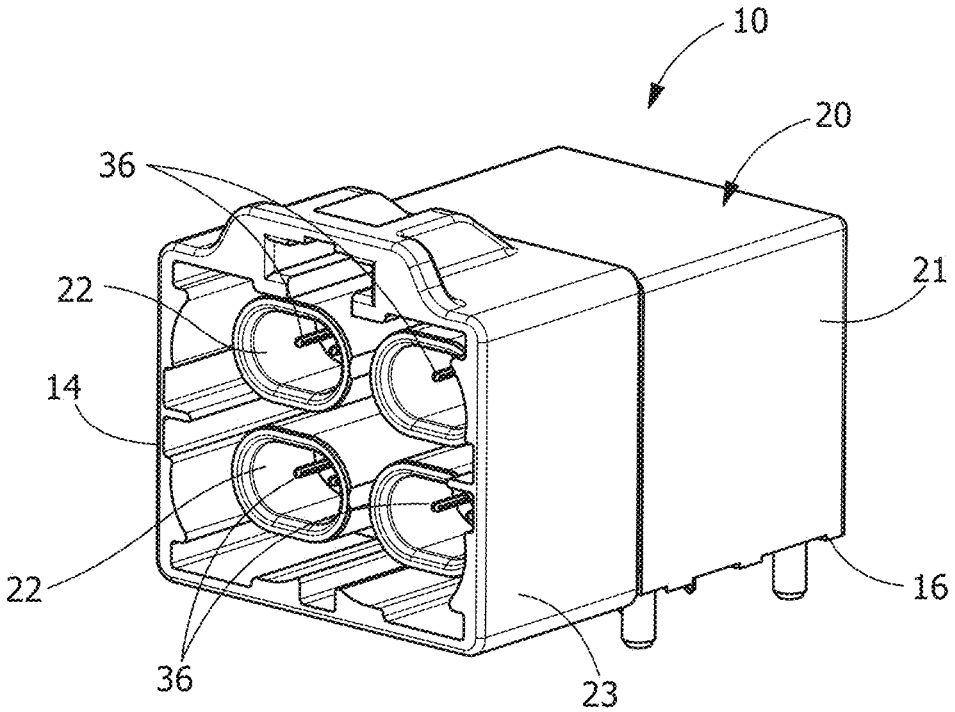
FIG. 1 is a front perspective view of an illustrative electrical connector with overmolded contacts of the present invention positioned in the housing.
Figure 2:
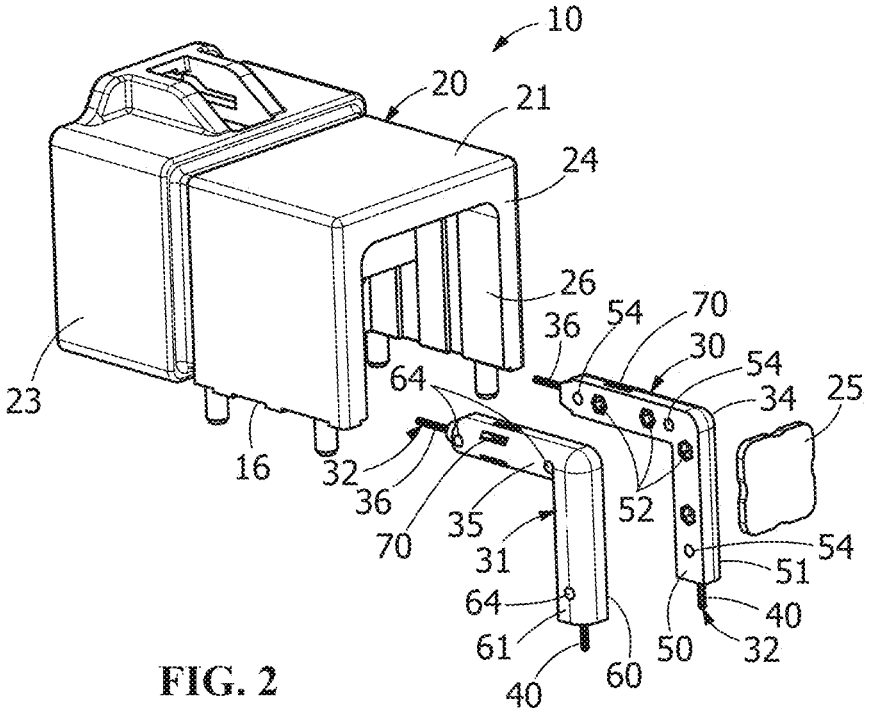
FIG. 2 is an exploded back perspective view of the electrical connector of FIG. 1.

The description of illustrative embodiments according to principles of the present invention is intended to be read in connection with the accompanying drawings, which are to be considered part of the entire written description. In the description of embodiments of the invention disclosed herein, any reference to direction or orientation is merely intended for convenience of description and is not intended in any way to limit the scope of the present invention. Relative terms such as "lower," "upper," "horizontal," "vertical," "above," "below," "up," "down," "top" and "bottom" as well as derivative thereof (e.g., "horizontally," "downwardly," "upwardly," etc.) should be construed to refer to the orientation as then described or as shown in the drawing under discussion. These relative terms are for convenience of description only and do not require that the apparatus be constructed or operated in a particular orientation unless explicitly indicated as such. Terms such as "attached," "affixed," "connected," "coupled," "interconnected," and similar refer to a relationship wherein structures are secured or attached to one another either directly or indirectly through intervening structures, as well as both movable or rigid attachments or relationships, unless expressly described otherwise.

Moreover, the features and benefits of the invention are illustrated by reference to the preferred embodiments. Accordingly, the invention expressly should not be limited to such embodiments illustrating some possible non-limiting combination of features that may exist alone or in other combinations of features, the scope of the invention being defined by the claims appended hereto.

FIG. 1 illustrates a perspective view of an exemplary embodiment of an electrical connector 10. The connector 10 is a header connector that is configured to be mounted on a circuit board (not shown). As shown, the connector 10 has a mating face 14 for connecting to a mating connector (not shown) and a mounting face 16 for mating with a circuit board (not shown). In the exemplary embodiment, the mounting face 16 is substantially perpendicular to the mating face 14 such that the header connector 10 interconnects electrical components that are substantially at a right angle to each other. The mating face 14 of the connector 10 defines a back plane connector interface. In other embodiments, the connector 10 may be configured to interconnect electrical components that are at other than a right angle to each other.

While the invention will be described in terms of a connector carrying differential signals, it is to be understood that the following description is for illustrative purposes only and is but one potential application of the inventive concepts herein. It is appreciated that the benefits and advantages of the invention may accrue equally to other types of signal connectors and power connectors.

The illustrative connector 10 includes a dielectric housing 20 has a rear portion 21 and an overmolded front portion 23. In other embodiments, the front portion may be a separate piece which is attached to the rear portion 21. The housing 20 has contact receiving cavities 22 which extend from the mating face 14 to the mounting face 16. In the embodiment shown, four contact receiving cavities 22, but other numbers of contact receiving cavities may be provided. A back end 24 of the housing 20 has a contact insertion opening 26 which is positioned in line with the contact receiving cavities 22. A stamped rear cover 25 is provided to enclose the contact insertion opening 26 after the overmolded contact assemblies 30, 31 have been positioned in the housing 20.

Figure 6:
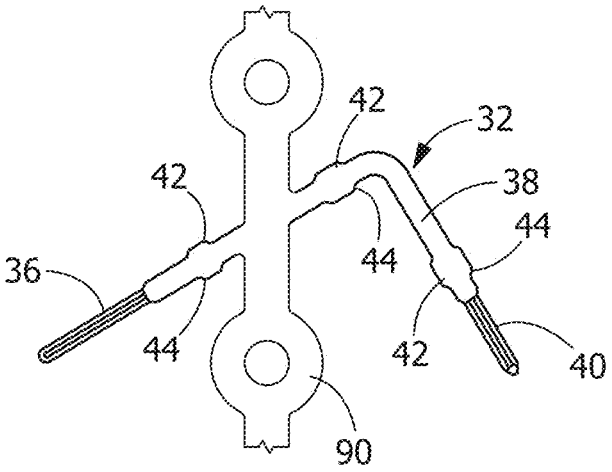
FIG. 6 is a plan view of an illustrative stamped contact on a carrier strip.
Figure 7:
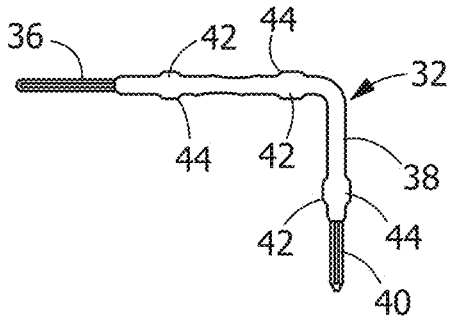
FIG. 7 is a plan view of the illustrative stamped contact of FIG. 6 removed from the carrier strip.
Figure 8:
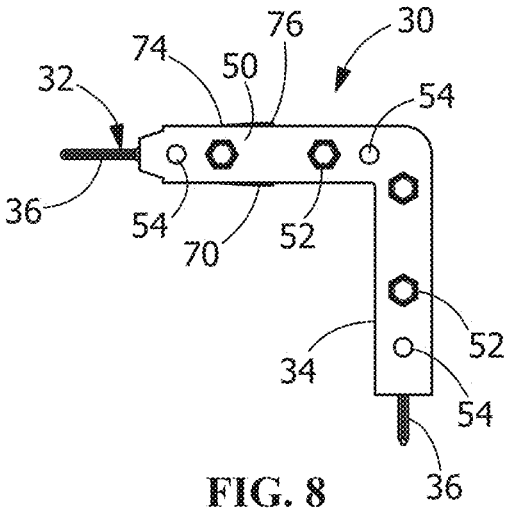
FIG. 8 is a plan view of the illustrative stamped contact of FIG. 7 with dielectric material overmolded over portions of the contact.
Figure 9:
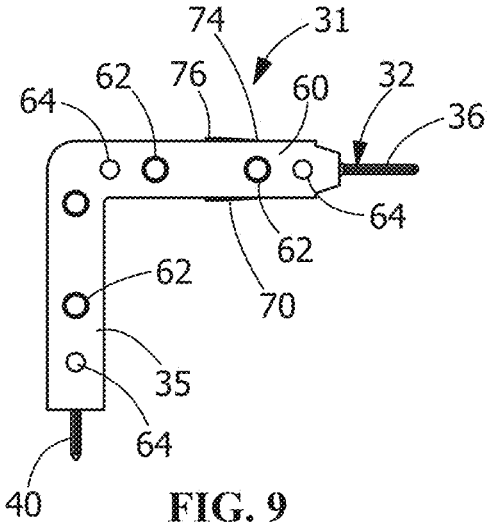
FIG. 9 is a perspective view of the illustrative overmolded stamped contact of FIG. 8 assembled to a second overmolded stamped contact.

Referring to FIGS. 2 through 5, overmolded contact assemblies 30, 31 have contacts 32 and overmolded housings 34, 35. The contacts 32, as shown in FIGS. 6 and 7, have mating contact portions 36, securing portions 38 and mounting contact portions 40. The securing portions 38 have enlarged portions 42 spaced periodically thereon. The enlarged portions 42 have securing shoulders 44. In the illustrative embodiment shown, the mating contact portions 36 and the mounting contact portions 40 are pins. However, the mating contact portions 36 and the mounting contact portions 40 may have different configurations without departing from the scope of the invention. In the illustrative embodiment shown the securing portions 38 are bent 90 degrees, allowing the mating contact portions 36 to be perpendicular to the mounting contact portions 40. In other embodiments, the securing portions 38 may be bent at different angles or may not be bent.

Figure 3:
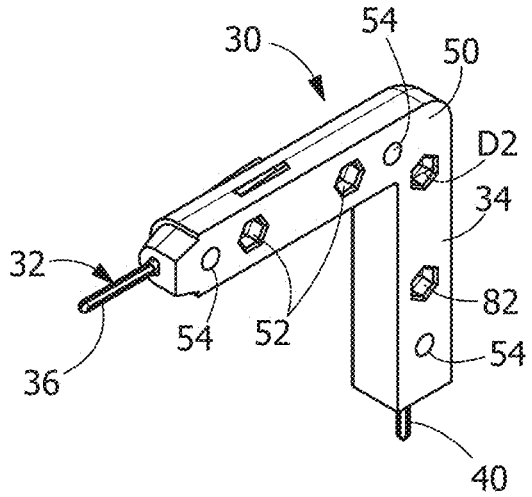
FIG. 3 is a first side perspective view of a first overmolded contact.
Figure 4:
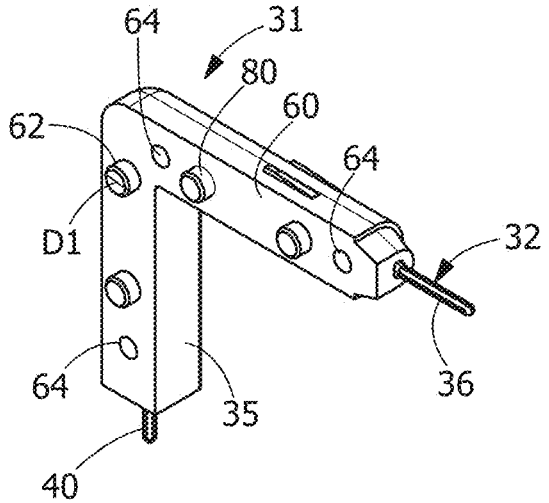
FIG. 4 is a second side perspective view of a second overmolded contact.

As shown in FIGS. 3 and 4, the housings 34, 35 are overmolded onto the securing portions 38 of each contact 32. In the illustrative embodiment shown in FIG. 3, a first side 50 of the housing 34 has recesses 52 provided thereon. In the embodiment shown, four recesses 52 are provided, however, other numbers of recesses 52 may be used. The recesses 52 are in the shape of a hexagon, but other shapes may be used. The first side 50 also has circular openings 54 which extend to the securing portion 38 of the contact 32. The circular openings 54 are a result of the manufacturing process, which will be more fully described. A second side 51 of the housing 34 of the contact assembly 30 also has openings (not shown) which are equal to the number of openings 54 provided on the first side 50 of a mating contact assembly 30. In addition, the positioning of the openings on the second side 51 relative to the mating contact portions 36 and the mounting contact portions 40 is identical to the positioning of the openings 54 on the first side 50 relative to the mating contact portions 36 and the mounting contact portions 40. The shape of the openings 54 may vary without departing from the scope of the invention.

In alternate embodiments, the recesses 52 and openings 54 on the first side 50 of the housing 34 may be positioned in the same location. Alternatively, the openings 54 may not be present if different manufacturing process are used.

In the illustrative embodiment shown in FIG. 4, a second side 60 of the housing 35 has projections 62 provided thereon. In the embodiment shown, four projections 62 are provided, however, other numbers of projections 62 may be used. The projections 62 are in the shape of a cylinder, but other shapes may be used. The number of the projections 62 provided on the second side 60 of the overmolded housing 35 of the mating contact assembly 31 may vary, but is equal to the number of recesses 52 provided on the first side 50 of the overmolded housing 34 of the mating contact assembly 30. In addition, the positioning of the projections 62 on the second side 60 relative to the mating contact portions 36 and the mounting contact portions 40 is identical to the positioning of the recesses 52 on the first side 50 relative to the mating contact portions 36 and the mounting contact portions 40.

The second side 60 has circular openings 64 which extend to the securing portion 38 of the contact 32. The circular openings 64 are a result of the manufacturing process, which will be more fully described. The shape of the openings 64 may vary without departing from the scope of the invention. In addition, the openings 64 may not be present if different manufacturing process are used. In the illustrative embodiment shown, the number of the openings 64 provided on the second side 60 of a mating contact assembly 31 may vary. A first side 61 of the housing 35 of the contact assembly 31 also has openings 64 which are equal to the number of openings 64 provided on the second side 60 of a mating contact assembly 31. In addition, the positioning of the openings 64 on the first side 61 relative to the mating contact portions 36 and the mounting contact portions 40 is identical to the positioning of the openings 64 on the second side 60 relative to the mating contact portions 36 and the mounting contact portions 40.

Figure 5:
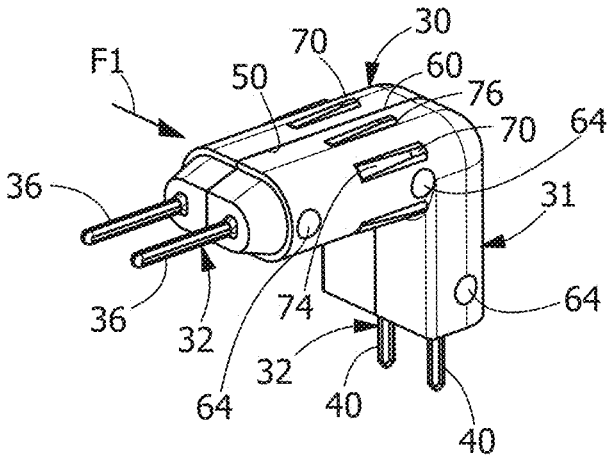
FIG. 5 is a perspective view of the first overmolded contact and the second overmolded contact mated together.

As shown in FIG. 5, latching projections 70 are provided on the overmolded housings 34, 35. The latching projections 70 have sloped surfaces 74 and shoulders 76.

In use, two or more overmolded contact assemblies 30, 31 are mated together prior to being inserted into the contact receiving cavities 22. During mating, the first side 50 of the housing 34 of one contact assembly 30 is moved into engagement with the second side 60 of the housing 35 of a second contact assembly 31. As this occurs, the projections 62 of the second side 60 of the housing 35 of the second contact assembly 31 are moved into the recesses 52 of the first side 50 of the housing 34 of first contact assembly 30. As the number of the projections 62 is equal to the number of recesses 52, and as the positioning of the projections 62 is identical to the positioning of the recesses 52, the insertion of the projections 62 into the recesses 52 ensures that the first overmolded contact assembly 30 is properly aligned with the second overmolded contact assembly 31.

The diameter D1 of the projections 62 are proximate to, but slightly larger than the diameter D2 of the recesses 52. As the first overmolded contact assembly 30 and the second overmolded contact assembly 31 are moved together, a small force in the direction of F1 (FIG. 5) is applied to one or both of the overmolded contact assemblies 30, 31. The force F1 causes the projections 62 to enter the recesses 52, such that walls 80 of the projections 62 frictionally engage walls 82 of the recesses 52 to provide an interference fit therebetween. The force F1 is continued until the first side 50 of the first contact assembly 30 engages the second side 60 of the second contact assembly 31. In this position, the force F1 is removed, and the frictional engagement between the projections 62 and recesses 52 retains the first contact assembly 30 in position relative to the second contact assembly 31.

In alternate embodiments, a single contact assembly 30 has recesses 52 provided on a first side surface 50 and projections 62 provided on a second side surface 51, thereby allowing a contact assembly to be mounted on the first side surface 50 and another contact assembly to be mounted on the second side surface 51.

With the contact assemblies 30, 31 properly mated, the mated contact assemblies 30, 31 are inserted through the contact insertion opening 26 of the rear portion 21 of the housing 20. When fully inserted, the mating contact portions 36 are positioned in the contact receiving cavities 22 proximate the mating face 14 of the overmolded front portion 23 of the housing. The mounting contact portions 40 extend from the mounting face 16 of the rear portion 21 of the housing 20. The latching projections 70 of the contact assemblies 30, 31 engage walls of the contact receiving cavities 22 to retain the contact assemblies 30, 31 in position. With the contact assemblies 30, 31 properly positioned, the rear cover 25 is moved into position to cover the contact insertion opening 26.

Referring to FIGS. 6 through 9, the method of manufacturing the overmolded contact assembly 30 is shown. The contact 32 is initially stamped and formed and transported via a carrier strip 90, as shown in FIG. 6. The contact 32 is then removed from the carrier strip 90. The individual contact 32 (FIG. 7) is moved to a molding station (not shown). Holding arms (not shown), engage the contact 32 while the contact 32 is in the molding station. The holding arms apply a force, which is perpendicular to the surface of the contact 32, at discrete locations on the contact 32, such as at the enlarged portions 42. The enlarged portions 42 provide a greater surface area than the remainder of the securing portion 38, thereby providing more surface area for the holding arms to engage. The holding arms retain the contact 32 is position.

With the contact 32 retained in position, dielectric material flows over, or is overmolded, over the contact 32 to form the housing 34, 35. As this occurs, the dielectric material flows around the securing portion 38 of the contact 32 and around the enlarged portions 42. The dielectric material then cures. Since the holding arms retain the contacts 32 as the material flows, the openings 54, 64 are created by the holding arms and remain when the material is cured and the holding arms are retracted from the contacts 32. With the dielectric material cured, the enlarged portions 42, and in particular, the securing shoulders 44 of the enlarged portions 42, cooperate with the dielectric material to prevent the movement of the securing portion 38 and the contact 32 relative to the dielectric material and the housing 34, 35. During the overmolding process, the die in which the contact 32 is held has projections which extend into the mold cavity to prevent the flow of material in designated areas to create the recesses 52. As a result, the recesses 52 allow the flow of material in designated areas to create the projections 62 in the contact assemblies 30, 31.

With the dielectric material of the housing 34, 35 properly cured, the holding arms are retracted, leaving the openings 54 and 64, as the material was prevented from flowing at the locations where the holding arms were present. The overmolded contact assembly 30, 31 is removed from the die and assembled to other overmolded contact assemblies 30, 31 and/or inserted to the housing 20 of the electrical connector 10.

In alternate embodiments, the contact 32 may be moved the molding station while still attached to the carrier strip 90, allowing more than one contact 32 to be overmolded at the same time. In such embodiments, the contact strip 90 is removed after the dielectric material of the housing 34, 35 has cured. In addition, as the carrier strip 90 can be used to maintain the position of the contacts 32 in the die, holding arms are not needed. Consequently, overmolded contact assemblies 30, 31 made according to this process would not have openings 54 provided on the first side 50 or the second side 60. However, the other components of the contact 32 and housing 34, 35 remain the same as described above.

The contact assemblies 30, 31 may be formed using different methods. One such method includes: positioning a contact 32 in a mold, the contact 32 having a securing portion 38; holding the contact 32 at discrete locations 42 of the securing portion 38; overmolding a housing 34, 35 over the securing portion 38 of the contact; and forming at least one mating member 52, 62 on a side 50, 60 of the housing 34, 35 during the overmolding. The at least one mating member 52, 62 may be, but is not limited to, a recess 52 and/or projection 62.

While the invention has been described with reference to a preferred embodiment, it will be understood by those skilled in the art that various changes may be made and equivalents may be substituted for elements thereof without departing from the spirit and scope of the invention as defined in the accompanying claims. One skilled in the art will appreciate that the invention may be used with many modifications of structure, arrangement, proportions, sizes, materials and components and otherwise used in the practice of the invention, which are particularly adapted to specific environments and operative requirements without departing from the principles of the present invention. The presently disclosed embodiments are therefore to be considered in all respects as illustrative and not restrictive, the scope of the invention being defined by the appended claims, and not limited to the foregoing description or embodiments.

The invention claimed is:

1. A contact assembly for mating with adjacent contact assemblies and insertion into an electrical connector, the contact assembly comprising: a single contact having a mating contact portion, a securing portion and a mounting contact portion, the mating contact portion extending approximately perpendicular to the mounting contact portion; a single contact overmolded housing, the single contact overmolded housing being overmolded onto the securing portion of the single contact, the single contact overmolded housing having a first side with at least one recess and oppositely facing a second side with at least one projection; wherein the first side of the single contact overmolded housing is configured to be mounted to a first adjacent single contact overmolded housing of a first adjacent contact assembly of the adjacent contact assemblies and the second side of the single contact overmolded housing is configured to be mounted to a second adjacent single contact overmolded housing of a second adjacent contact assembly of the adjacent contact assemblies, wherein the positioning of the at least one projection on the second side of the single contact overmolded housing relative to the mating contact portion and the mounting contact portion is identical to the positioning of the at least one recess on the first side of the single contact overmolded housing relative to the mating contact portion and the mounting contact portion.

2. The contact assembly as recited in claim 1, wherein the at least one recess is in the shape of a hexagon.

3. The contact assembly as recited in claim 2, wherein the at least one projection is in the shape of a cylinder.

4. The electrical connector as recited in claim 1, wherein a number of the at least one projections provided on the second side of the single contact overmolded housing are equal to a number of at least one recesses provided on the first side of the single contact overmolded housing.

5. The contact assembly as recited in claim 1, wherein the securing portions of the contact have enlarged portions, the enlarged portions have securing shoulders.

6. The contact assembly as recited in claim 1, wherein the mating contact portion and the mounting contact portion are pins.

7. The contact assembly as recited in claim 1, wherein a latching projection is provided on a surface of the single contact overmolded housing, the latching projection has a sloped surface and a shoulder.

8. A housing having a mating face and a mounting face, contact receiving cavities extend from the mating face to the mounting face; a first overmolded contact assembly provided in the contact receiving cavities, the first overmolded contact assembly comprising: a first single contact having a first mating contact portion, a first securing portion and a first mounting contact portion; a first overmolded housing, the first overmolded housing being overmolded onto the first securing portion of the first single contact, the first overmolded housing having a first overmolded housing first side with at least one recess and an oppositely facing first overmolded housing second side with at least one projection wherein the first side and the second side of the first overmolded housing have openings which extend to the securing portion of the contact, the positioning of the openings on the second side relative to the mating contact portions and the mounting contact portions is identical to the positioning of the openings on the first side relative to the mating contact portions and the mounting contact portions; a second single overmolded contact assembly provided in the contact receiving cavities, the second overmolded contact assembly comprising: a second contact having a second mating contact portion, a second securing portion and a second mounting contact portion; a second overmolded housing, the second overmolded housing being overmolded onto the second securing portion of the second single contact, the second overmolded housing having a second overmolded housing first side with at least one recess and an oppositely facing second overmolded housing second side with at least one projection.

9. The electrical connector as recited in claim 8, wherein first sides of the first and second overmolded housings have at least one recess and second sides of the first and second overmolded housings have at least one projection.

10. The electrical connector as recited in claim 9, wherein the at least one recesses are in the shape of hexagons and the at least one projections are in the shape of cylinders.

11. The electrical connector as recited in claim 9, wherein the positioning of the at least one projection on the second sides relative to the mating contact portions and the mounting contact portions is identical to the positioning of the at least one recess on the first sides relative to the mating contact portions and the mounting contact portions.

12. The electrical connector as recited in claim 11, wherein a number of the at least one projections provided on the second sides of the overmolded housings are equal to a number of at least one recesses provided on the first sides of the overmolded housings.

13. The electrical connector as recited in claim 8, wherein the securing portions of the contacts have enlarged portions spaced periodically thereon.

14. The electrical connector as recited in claim 13, wherein the enlarged portions have securing shoulders.

15. The electrical connector as recited in claim 8, wherein the mating contact portions and the mounting contact portions are pins.

16. The electrical connector as recited in claim 8, wherein latching projections are provided on surfaces of the overmolded housings, the latching projections have sloped surfaces and shoulders which cooperate with the contact receiving cavities to retain the overmolded contact assemblies in the contact receiving cavities.

* * * * *